United States Patent [19]

Brandenburg

[11] 3,962,991

[45] June 15, 1976

[54] DEVELOPING DEVICE FOR SERIAL ELECTROSTATIC PRINTING

[75] Inventor: Klaus Brandenburg, Wehbach, Germany

[73] Assignee: U.S. Philips Corporation, Briarcliff Manor, N.Y.

[22] Filed: Jan. 24, 1975

[21] Appl. No.: 543,820

[30] Foreign Application Priority Data

Feb. 20, 1974 Germany ..... 2408077

[52] U.S. Cl. ..... 118/635

[51] Int. Cl.[2] ..... G03G 13/09

[58] Field of Search ..... 118/637; 427/18; 355/3 DD; 96/15 D; 101/DIG. 13

[56] References Cited

UNITED STATES PATENTS

| | | | |
|---|---|---|---|
| 2,173,741 | 9/1939 | Wise et al. | 118/637 |
| 2,577,894 | 12/1951 | Jacob | 118/637 |
| 2,784,694 | 3/1957 | Crumrine | 118/637 |
| 2,874,063 | 2/1959 | Greig | 118/637 |
| 2,880,696 | 4/1959 | Clark et al. | 118/637 |
| 2,985,135 | 5/1961 | Hickerson | 118/637 |
| 3,740,265 | 6/1973 | Springer | 118/637 |

*Primary Examiner*—Louis K. Rimrodt
*Attorney, Agent, or Firm*—Frank R. Trifari; David R. Treacy

[57] ABSTRACT

In a serial electrostatic printer, the developing device has a magnetic brush feeding toner to the record carrier, divided into a large number of magnetic regions. The magnetic region trailing the printing location is activated after printing.

5 Claims, 2 Drawing Figures

DEVELOPING DEVICE FOR SERIAL ELECTROSTATIC PRINTING

BACKGROUND OF THE INVENTION

1. Field of the Invention

The invention relates to a developing device for serial electrostatic printing of alphanumeric characters on a record carrier, in which the latent image is brought into contact, immediately after printing, with developer which is applied to the record carrier by a rotatable magnetic roller which is arranged parallel to the record carrier.

2. Description of the Prior Art

Known electrostatic writing methods have an annoying aspect in that the latent images become visible only after departure from the developing chamber, i.e. after the record carrier has been further transported over several lines. In order to solve this problem, in a known line printer the developing chamber filled with toner mixture is arranged underneath the printing station and a rotatably journalled magnet is mounted at the rear of the record carrier, so that part of the toner mixture is pulled upwards at the area of the printing station as soon as the line has been printed (German Offenlegungsschrift No. 2,064,036).

Also known is a serial printing device in which the printing head is step-wise moved over the record carrier, the head being continuously present in the developing mixture. A magnetic brush is rotatably arranged parallel to the printing head guide over the full width of the record carrier, so that the developing mixture is continuously in contact with the record carrier at the area of the printing line (German Offenlegungsschrift No. 2,125,081). However, in this serial printing device the printed line again becomes visible only after the record carrier has been transported one line further.

In both known devices the possibility of making the images quickly visible exists because of bringing the electrode pins directly into contact with the developer. However, fast contamination of the printing heads is then unavoidable.

SUMMARY OF THE INVENTION

The object of the invention has for its object to provide an electrostatic serial printing device in which on the one hand the printing method is performed in the conventional sequence, i.e. first printing the latent image without influencing the developer, followed by the development, while on the other hand the latent images are made visible immediately after printing, i.e. while the relevant line is still being printed. To this end, in a device according to the invention the magnetic roller is divided into a large number of separate magnetic regions which are successively active and inactive depending on the location of the printing head.

One embodiment according to the invention will be described in detail hereinafter with reference to the drawing.

DESCRIPTION OF THE PREFERRED EMBODIMENTS

Figure 1:
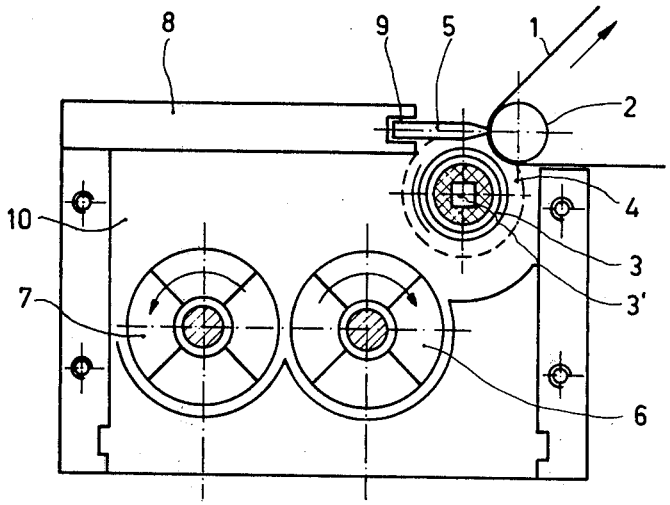
FIG. 1 is a sectional view of the developing device according to the invention.

All parts of the serial printing device which are not absolutely necessary for a clear understanding of the invention have been omitted in the figures. A developing chamber 10 in known manner contains a powdery developing mixture of toner particles and carrier particles. This developing mixture is constantly mixed by mixing rollers 6 and 7. The developing chamber 10 is closed at the top by a cover plate 8, in the front of which a guide 9 for an electrostatic printing head 5 is provided. The guiding direction is denoted by the reference P. It is obvious that any other known device for the serial movement, i.e. the step-wise or uninterrupted movement, of the printing head 5 can also be used. A counter electrode 2 is rotatably arranged opposite the printing head 5, a record carrier 1 being guided in known manner about the said counter electrode.

A tube 3 is journalled to be rotatable about a fixed magnetic rod 3' in the side walls of the developing chamber, parallel to the record carrier and obliquely below the counter electrode 2. This tube 3 serves to draw the developing agent, continuously mixed by rollers 6 and 7, upwards from the developing chamber 10 and to feed it to the record carrier 1. The developer then adheres to the surface of the tube 3 in a radiant manner, thus forming a developing brush 4.

Figure 2:
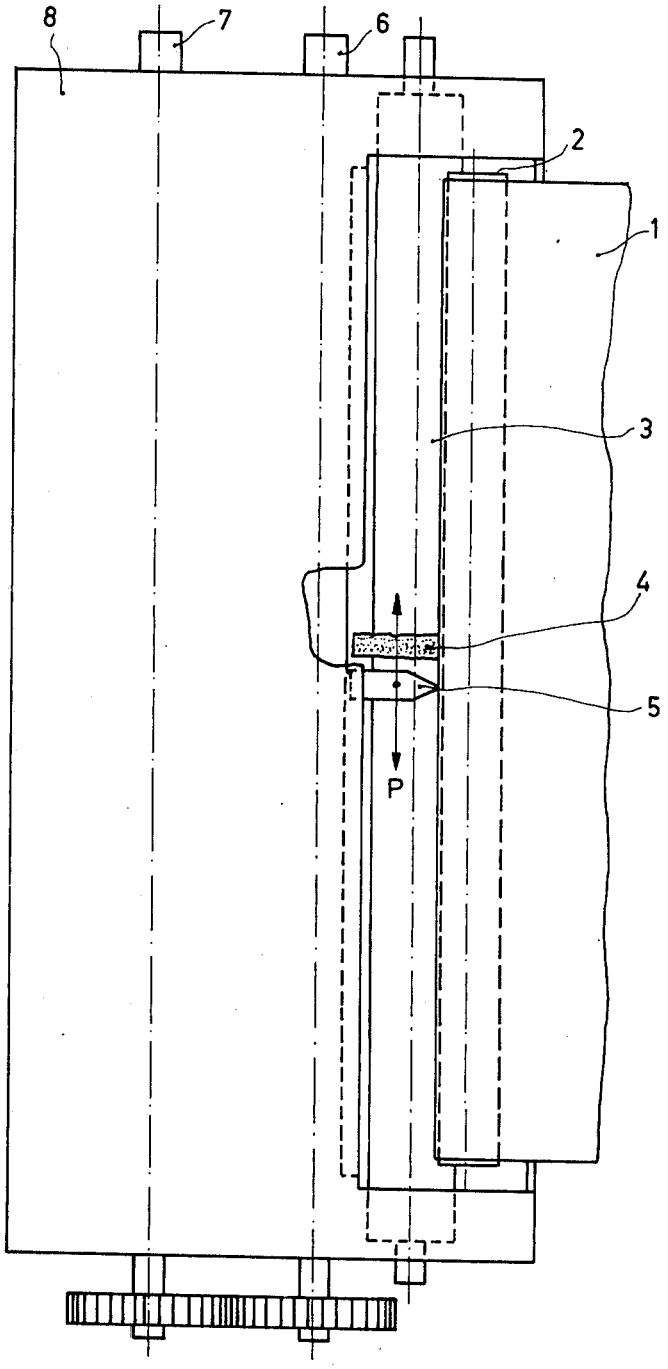
FIG. 2 is a plan view of the device of FIG. 1.

The invention consists in that the magnetic rod 3' is not permanently magnetically active, but that it is divided into a large number of portions along the record carrier 1, which are made magnetic or non-magnetic depending on the location of the printing head 5. The magnetic region is then usually situated behind the printing head 5, looking in the movement direction P of the printing head 5, but never at the area of the printing head 5. In order to avoid contamination of the printing head 5, it is advantageous to make the magnetized region, and hence the region 4 in contact with the developer, lag the printing head by about two characters. In the embodiment shown in FIG. 2, the printing head 5 moves from left to right. The developing region 4 then lags the printing head 5. If the printing head 5 were to move from right to left, the developing region to the right of the printing head 5 would also lag the head. The width of the developing region 4 amounts to at least the width of one character, but may also amount to the combined width of several characters.

The technical realization of the described action of the magnetic roller 3 is not further elaborated in the figures. It may consist, for example, of the successive excitation of a number of electromagnets, or the successive removal of shields of permanent magnets.

What is claimed is:

1. A developing device for serial electrostatic printing of alphanumeric characters on a record carrier, in which the latent image is brought into contact, immediately after the printing, with developer which is applied to the record carrier by a rotatable magnetic roller which is arranged parallel to the record carrier, wherein the magnetic roller is divided into a large number of separate magnetic regions which are successively active and non-active depending on the location of the printing head.

2. A developing device as claimed in claim 1, wherein the separate magnetic regions of the magnetic rollers are effective for some characters behind the printing head in the movement direction of the printing head.

3. A developing device as claimed in claim 1, wherein the width of the separate magnetic regions corresponds to the width of the characters.

4. A developing device as claimed in claim 1, wherein the width of the separate magnetic regions corresponds to the width of only a few characters.

5. A developing device as claimed in claim 1, wherein the magnetic roller comprises a fixed magnetic rod which is enclosed by a rotatable tube, the magnetic rod being divided into separate magnetic regions.

* * * * *